US009144275B1

(12) United States Patent
Birnbaum

(10) Patent No.: US 9,144,275 B1
(45) Date of Patent: Sep. 29, 2015

(54) SHOE FOR CANES AND CRUTCHES

(71) Applicant: Bernardo Birnbaum, Aventura, FL (US)

(72) Inventor: Bernardo Birnbaum, Aventura, FL (US)

( * ) Notice: Subject to any disclaimer, the term of this patent is extended or adjusted under 35 U.S.C. 154(b) by 0 days.

(21) Appl. No.: 14/463,728

(22) Filed: Aug. 20, 2014

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01); *A61H 2003/0211* (2013.01)

(58) Field of Classification Search
CPC . A45B 9/04; A61H 3/0288; A61H 2003/0211
USPC ..... 135/77, 82, 84, 86
See application file for complete search history.

(56) References Cited

U.S. PATENT DOCUMENTS 2,230,406 A * 2/1941 Johnson ..... 135/77
2,857,925 A * 10/1958 Higginbotham ..... 135/86
3,289,685 A * 12/1966 Parker ..... 135/65
4,899,771 A * 2/1990 Wilkinson ..... 135/77
4,947,882 A * 8/1990 Levasseur ..... 135/84
6,230,726 B1 * 5/2001 Dell ..... 135/65
6,883,530 B2 * 4/2005 Kawakami ..... 135/84
2009/0235966 A1 * 9/2009 Birnbaum ..... 135/66
2010/0313925 A1 * 12/2010 Jiang ..... 135/82
2013/0276845 A1 * 10/2013 Moulton ..... 135/72

FOREIGN PATENT DOCUMENTS

FR 2973201 A1 * 10/2012
WO WO 0117798 A1 * 3/2001

* cited by examiner

*Primary Examiner* — David R Dunn
*Assistant Examiner* — Danielle Jackson
(74) *Attorney, Agent, or Firm* — Jesus Sanchelima, Esq.; Christian Sanchelima, Esq.

(57) ABSTRACT

A shoe for the sticks canes and crutches having a base member with four outwardly extending pads and a central flat portion. A frustoconical top member mounted above the base member is joined to a cup member for receiving the distal end of a cane or crutch member. The junction between the top member and the cup member define a waist portion that is flexible and resilient mimicking the movement of a human ankle when a person walks. Irregularities on the bottom of the pads 24 and underside 22 enhance the traction.

6 Claims, 3 Drawing Sheets

SHOE FOR CANES AND CRUTCHES

II. BACKGROUND OF THE INVENTION

1. Field of the Invention

The present invention relates to shoes for canes and crutches and, more particularly, to those shoes that mimic the movement of human ankle articulations.

2. Description of the Related Art

Several designs for shoes have been designed in the past. None of them, however, include a combination of parts that in addition to providing the necessary traction, permit a user to land, lean, and leave the supporting surface as if he/she had been using his/her foot and ankle.

III. SUMMARY OF THE INVENTION

It is one of the main objects of the present invention to provide a shoe for canes and crutches that substantially mimics or follows the movement of person's ankle.

It is another object of this invention to provide a shoe capable of providing traction and stability to a cane or crutches user.

It is still another object of the present invention to provide a shoe that is reliable.

Yet another object is to provide a shoe that is functional in any direction.

It is yet another object of this invention to provide such a shoe that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 8:
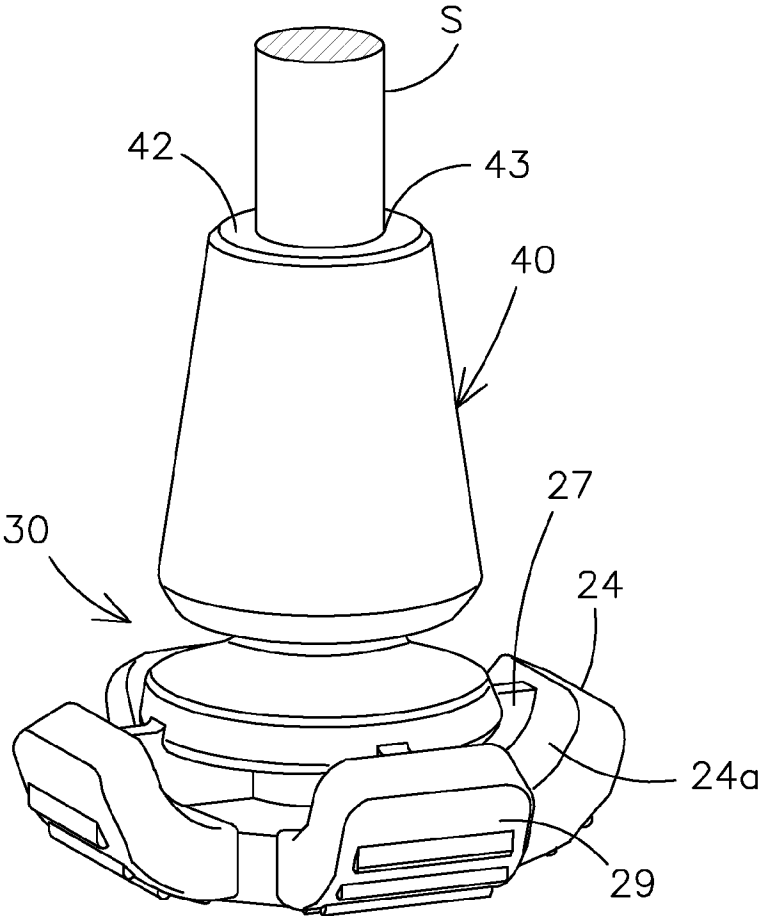
Figure 7:
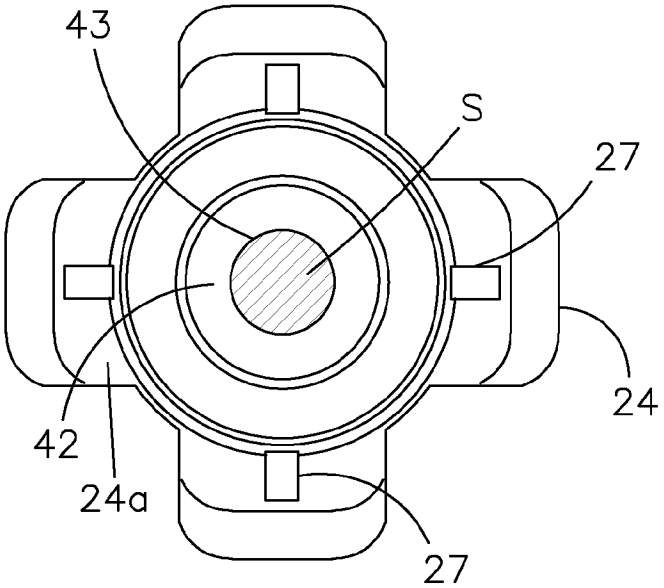
FIG. 7 is a top view of shoe 10.

FIG. 8 in an inclined view of the shoe.

V. DETAILED DESCRIPTION OF THE EMBODIMENTS OF THE INVENTION

Figure 6:
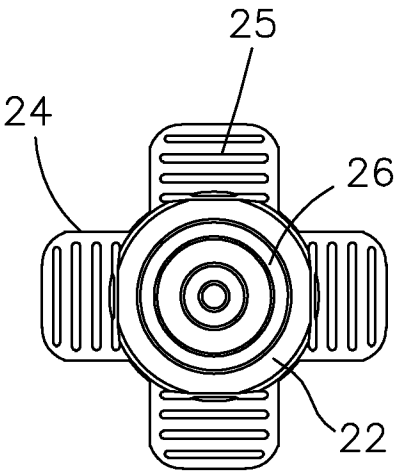
FIG. 6 is a bottom view of shoe 10.
Figure 5:
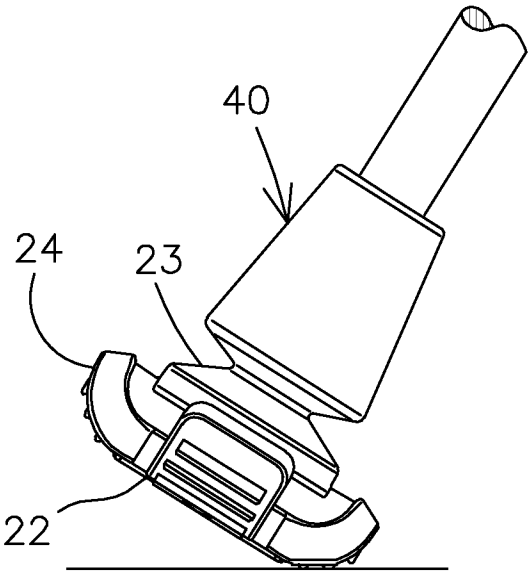
FIG. 5 shows the shoe 10 represented in the previous figure as the user releases the weight (force) applied to shoe 10.

Referring now to the drawings, where the present invention is generally referred to with numeral 10, it can be observed that it basically includes support base assembly 20 with frustoconical top 23 mounted thereon and connected to cup assembly 40 through waist portion 30. The distal end of a stick S is received, snuggly, within cup assembly 40, as seen in FIGS. 1 through 5. Base assembly 20 includes an underside 22, best seen in FIG. 6, with two pairs of arched pads 24, perpendicularly disposed with respect to each other. Pads 24 include serrations 25 that can be substituted for equivalent irregularities to enhance traction. Arched pads 24 permit a user more freedom than other configurations. The central portion 26 has preferably circular designs to avoid more traction or restriction in a given direction.

Figures 1, 2, 3:
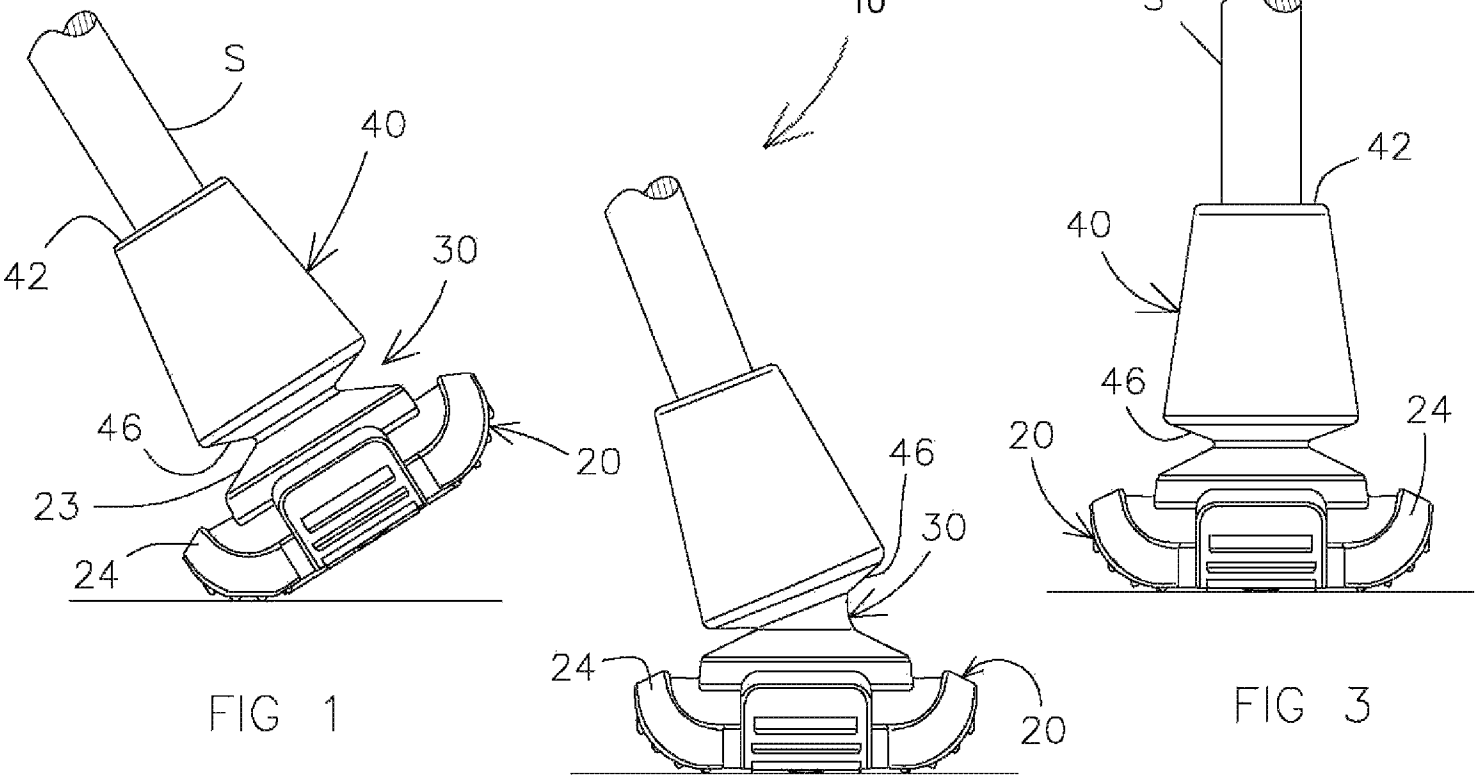
FIG. 1 represents an elevated view of a shoe, subject of this application, upon landing on a supporting surface, before any force (weight) is applied.
FIG. 2 shows the shoe represented in the previous figure with the user's weight being applied at an approaching angle causing the waist portion 30 of shoe 10 to flex.
FIG. 3 illustrates shoe represented in the previous figure with the user's weight being applied perpendicularly.
Figure 4:
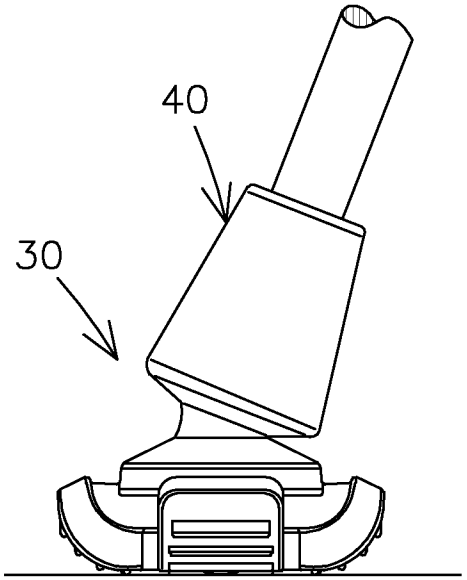
FIG. 4 is a representation of the shoe 10 shown in the previous figure as the user's weight is being released and the waist portion 30 is flexed.

When a cane or crutch is used, a user's gait goes through different continuously linked stages that can be generally characterized as:

1. Landing approach starting with initial contact of the shoe with a supporting surface, as shown in FIG. 1.
2. Increasing rate of support during which a user increasingly applies his/her weight, as shown in FIG. 2.
3. Maximum support corresponds to the substantially vertically position when maximum weight is typically applied. This is represented in FIG. 3.
4. Decrease rate of support is experienced as the user leaves behind the contact area of the shoe and supporting surface, as seen in FIG. 4.
5. Release or departing stage corresponds to the position just prior to eliminating the contact between the shoe and the supporting surface.

Shoe 10, as seen in FIGS. 1 through 5, basically mimics the different positions or stages through which a human ankle passes. Shoe 10 is made out of solid rubber, in one of the preferred embodiments. Cup assembly 40 has, in one of the embodiments, a frustoconical shape with open end 42 with opening 43 for receiving the end of stick S. Bottom end 46 also has a frustoconical shape and is integrally connected with upper end of top 23. The reduced waist of shoe 10 at the junction peripheral area acts as an integrated hinge to facilitate a resilient bending. The at rest straight portion of shoe 10 is proportionally changed with the force (weight) applied by user through stick S.

Users of canes and crutches do not necessarily apply their weight with shoes 10 pointing parallel to the path followed. Shoes 10 are typically rotated slightly outwardly. Therefore, underside 22 has a round shape and arched pads 24 extend outwardly from the periphery of underside 22 to increase the effective contact area in the landing approach stage. Reinforcement webs 27 extend perpendicularly from base assembly 20 to the inner surfaces 24*a* of pads 24.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoe (10) for canes and crutches comprising a unitary piece that comprises:

A) a base member (20) having a substantially flat central circular underside (22) and four flexible arched pads (24) extending outwardly from said underside (22) and each of said pads (24) perpendicularly disposed with respect to contiguous arched pads (24), said base member being in contact with a supporting surface by either said underside (22) or said pads (24) and further including a top member (23); and B) a cup member extending from said top member and defining a resilient flexible waist portion as an integral continuation from said top member, and further including a top end with an opening for receiving the distal end of a cane or crutch member stick.

2. The shoe set forth in claim 1 wherein said waist portion allows said cup member to flex mimicking the movement of a human ankle.

3. The shoe set forth in claim 2 wherein said unitary piece is made out of rubber.

4. The shoe set forth in claim 3 wherein said pads include a bottom with irregularities for enhancing their traction.

5. The shoe set forth in claim 4 wherein said underside (22) includes circular irregularities to enhance its traction in any direction without restrictions.

6. The shoe set forth in claim 5 wherein said top member has a frustoconical shape with the narrowest end defining said waist portion.

* * * * *